US011572874B2

(12) United States Patent
Surjaatmadja et al.

(10) Patent No.: US 11,572,874 B2
(45) Date of Patent: Feb. 7, 2023

(54) SYSTEMS AND METHODS TO PUMP DIFFICULT-TO-PUMP SUBSTANCES

(71) Applicant: HALLIBURTON ENERGY SERVICES, INC., Houston, TX (US)

(72) Inventors: Jim Basuki Surjaatmadja, Duncan, OK (US); Timothy Holiman Hunter, Duncan, OK (US); Dickey Charles Headrick, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 923 days.

(21) Appl. No.: 16/327,195

(22) PCT Filed: Nov. 1, 2016

(86) PCT No.: PCT/US2016/059901
§ 371 (c)(1),
(2) Date: Feb. 21, 2019

(87) PCT Pub. No.: WO2018/084831
PCT Pub. Date: May 11, 2018

(65) Prior Publication Data

US 2021/0108631 A1 Apr. 15, 2021

(51) Int. Cl.
*F04B 47/04* (2006.01)
*E21B 43/26* (2006.01)
(Continued)

(52) U.S. Cl.
CPC ..... *F04B 47/04* (2013.01); *E21B 43/2607* (2020.05); *F04B 15/02* (2013.01); *F04B 49/00* (2013.01); *F04B 53/10* (2013.01)

(58) Field of Classification Search
CPC ..... E21B 43/26; E21B 43/2607; F04B 13/00; F04B 15/02; F04B 47/04; F04B 49/00; F04B 53/10
See application file for complete search history.

(56) References Cited

U.S. PATENT DOCUMENTS 4,021,156 A * 5/1977 Fuchs, Jr. ..... F01L 25/063 417/346
4,204,574 A 5/1980 Stalder
(Continued)

OTHER PUBLICATIONS

International Search Report and Written Opinion dated Jul. 20, 2017 for international patent application No. PCT/US2016/059901, filed on Nov. 1, 2016.

*Primary Examiner* — James G Sayre
(74) *Attorney, Agent, or Firm* — K&L Gates LLP

(57) ABSTRACT

Various embodiments include methods and apparatus structured to pump material, where such material is difficult to pump. In an embodiment, an apparatus can include an injector device capable of self-injecting material into a high pressure line. The apparatus may include multiple valves to control recharge of material into the injector device and to control reinjection of the material into the high pressure line. In an embodiment at a well site, a portion of fluid being injected into a wellbore can be diverted from one or more high pressure pumps to an injector device, where the diverted portion of the fluid can be used to power the injector device to inject material from a mixing tank to add material to the wellbore in addition to the non-diverted portion of the fluid injected into the wellbore. Additional apparatus, systems, and methods can be implemented in a variety of applications.

25 Claims, 7 Drawing Sheets

(51) Int. Cl.

| | |
|---|---|
| ***F04B 15/02*** | (2006.01) |
| ***F04B 49/00*** | (2006.01) |
| ***F04B 53/10*** | (2006.01) |

(56) References Cited

U.S. PATENT DOCUMENTS

| | | | | |
|---|---|---|---|---|
| 4,690,622 | A | 9/1987 | Decker | |
| 5,497,832 | A * | 3/1996 | Stuebinger | E21B 43/127 166/106 |
| 5,842,520 | A | 12/1998 | Bolin | |
| 5,899,272 | A * | 5/1999 | Loree | E21B 43/267 166/280.2 |
| 6,179,057 | B1 | 1/2001 | Fontana et al. | |
| 6,558,134 | B2 | 5/2003 | Serafin et al. | |
| 6,786,205 | B2 | 9/2004 | Stuhldreher et al. | |
| 7,249,634 | B2 | 7/2007 | Lima et al. | |
| 7,594,543 | B2 | 9/2009 | Lima et al. | |
| 8,336,631 | B2 | 12/2012 | Shampine et al. | |
| 8,714,253 | B2 | 5/2014 | Sherwood et al. | |
| 8,851,186 | B2 | 10/2014 | Shampine et al. | |
| 9,016,383 | B2 | 4/2015 | Shampine et al. | |
| 2002/0004014 | A1 | 1/2002 | Kohl et al. | |
| 2004/0136832 | A1 * | 7/2004 | Hammonds | F04B 9/113 417/43 |
| 2008/0105316 | A1 | 5/2008 | Serafin et al. | |
| 2009/0260826 | A1 | 10/2009 | Sherwood et al. | |
| 2010/0116508 | A1 | 5/2010 | Oglesby | |
| 2011/0176940 | A1 | 7/2011 | Ellis et al. | |
| 2012/0216889 | A1 | 8/2012 | Eide et al. | |
| 2012/0279720 | A1 | 11/2012 | Whitby et al. | |
| 2012/0279721 | A1 | 11/2012 | Surjaatmadja et al. | |
| 2014/0138454 | A1 | 5/2014 | Sturman | |
| 2014/0151019 | A1 | 6/2014 | Gano | |
| 2014/0262338 | A1 | 9/2014 | Shen et al. | |

* cited by examiner

403

| STAGE | A | B | C | D | E | F | G |
|---|---|---|---|---|---|---|---|
| INJECTION | 1 | 0 | 1 | 1 | 0 | 1 | 0 |
| | 0 | 0 | 1 | 1 | 0 | 1 | 0 |
| | 0 | 0 | 1 | 1 | 0 | 0 | 0 |
| | 0 | 0 | 1 | 0 | 0 | 0 | 0 |
| | 0 | 0 | 1 | 0 | 0 | 0 | 1 |
| | 0 | 1 | 1 | 0 | 0 | 0 | 1 |
| SUCTION | 0 | 1 | 1 | 0 | 1 | 0 | 1 |
| | 0 | 0 | 1 | 0 | 1 | 0 | 1 |
| | 0 | 0 | 1 | 0 | 0 | 0 | 1 |
| | 0 | 0 | 1 | 0 | 0 | 0 | 0 |
| | 0 | 0 | 1 | 1 | 0 | 0 | 0 |
| | 0 | 0 | 1 | 1 | 0 | 1 | 0 |
| INJECTION | 1 | 0 | 1 | 1 | 0 | 1 | 0 |

SYSTEMS AND METHODS TO PUMP DIFFICULT-TO-PUMP SUBSTANCES

TECHNICAL FIELD

The present invention relates generally to apparatus related to oil and gas exploration and production.

BACKGROUND

In oil and gas production, the oil or gas is pumped to the surface from regions below the surface. In some processes, one or more substances are injected into a wellbore as part of a treatment operation. Since injected fluids typically follow a path that provides least resistance, material, commonly referred to as diverters, can be pumped into the wellbore to focus on areas needing treatment. Current pump systems generally can pump most of the common diverters implemented. However, new type diverters, such as large plastic proppants or long fibers, often get stuck between a valve and a seat of the valve, causing it to stay slightly open. Then, under high pressures, the valve can leak and cause seat wear due to cavitation and other mechanisms. Enhancements to improve pump efficiency are desirable.

DETAILED DESCRIPTION

The following detailed description refers to the accompanying drawings that show, by way of illustration and not limitation, various embodiments in which the invention may be practiced. These embodiments are described in sufficient detail to enable those skilled in the art to practice these and other embodiments. Other embodiments may be utilized, and structural, logical, electrical, and mechanical changes may be made to these embodiments. The various embodiments are not necessarily mutually exclusive, as some embodiments can be combined with one or more other embodiments to form new embodiments. The following detailed description is, therefore, not to be taken in a limiting sense.

In various embodiments, a self-injecting pumping system can be arranged to be capable of pumping difficult-to-pump fluid material systems, such as large balls or long fibers. Such a self-injecting pump system can include an apparatus comprising an injector device capable of self-injecting the material into a high pressure line, powered by pressurized fluid in the high pressure line. The apparatus can include multiple valves to control recharge of material into the injector device and to control injection of the material into the high pressure line. The pumped fluid material can be commonly used diverters, while providing capabilities to pump future diverters. In various embodiments, a self injecting pump system may be structured with the following design considerations: a) the volume of diverters being relatively low, which can be handled by slower operating pump systems, b) positively closing valves be used, where slow closing is acceptable, c) in critical points in a system, dual barrier or quadruple barrier systems can be used, d) when opened, the flow rate can be low, corresponding to a low pressure differential, e) fracturing fluid pressure can be used to inject into itself, and f) power fluid used in the procedure can be returned to a blender from which it flowed.

Figure 1:
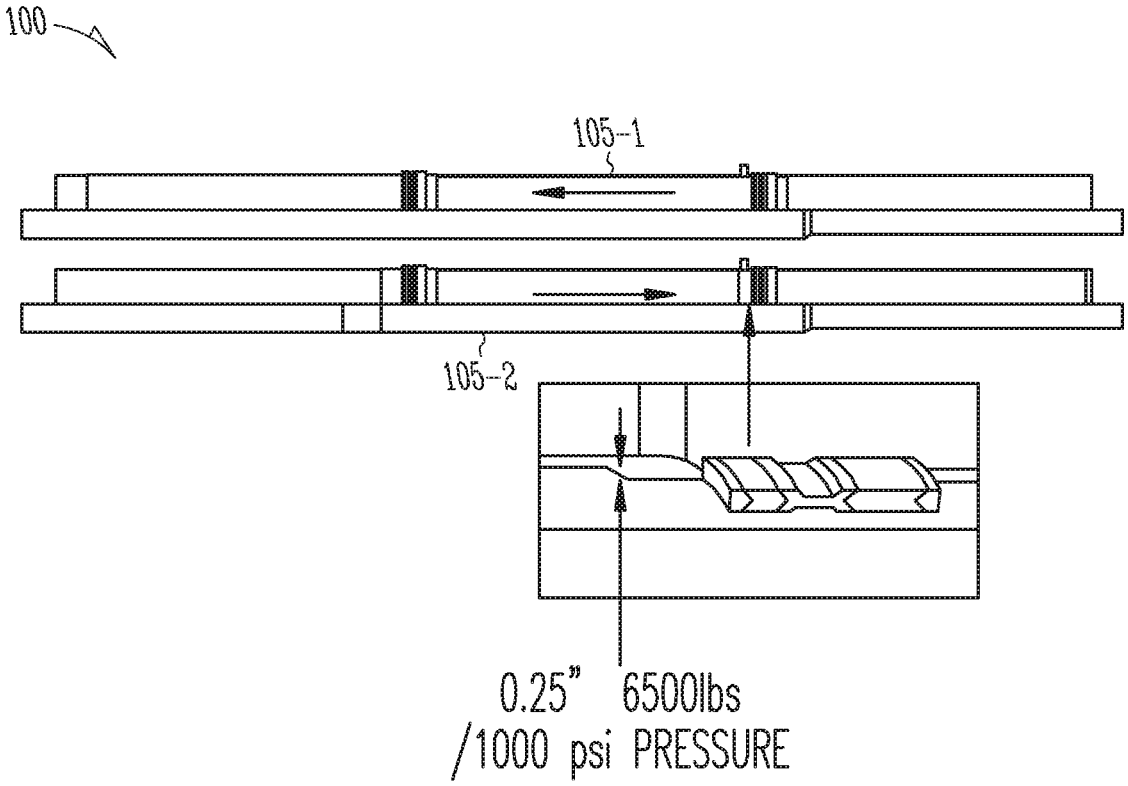
FIG. 1 is a representation of a pumping system 100 in an implementation using fracturing fluid energy, in accordance with various embodiments.

FIG. 1 is a representation of a pumping system 100 in an implementation using fracturing fluid. Fracturing fluid and fracturing pressure is also referred to, herein, as frac fluid and frac pressure. The pumping system 100 can employ a pressure intensifier type of approach, that is, pressure applied to a driver side creates a pressure intensification due to a smaller injector plunger. However, as shown, the injector plunger, as an example, can be 8 inches in diameter and the driver side can be only 8.5 inches in diameter, meaning that the net push force on the plunger is only 6500 lbs/1000 psi pressure of frac fluid. This means that the pressure differential provided is only 129 psi/1000 psi frac pressure. Whether or not this is too large or too small depends upon the application; but in general, this should be acceptable. Other diameters of the two sides can implemented.

For use in continuous pumping, the pumping system 100 of FIG. 1 can be a dual system having pumps 105-1 and 105-2. As shown, pump 105-1 is in a suction mode (suction stroke), and it fills (or sucks) quickly preparing for its discharge stroke. A stroking cycle is defined by the suction stroke and the discharge stroke. While it is discharging, pump 105-1 can meter out material slowly to create a continuous injection of this material that may be difficult to pump using conventional systems. The pump 105-2 can operate similar to pump—105-1, and can be synchronized in operation with pump 105-1 such that pump 105-2 injects, while the pump 105-1 is in the suction mode, as shown in FIG. 1.

Figure 2:
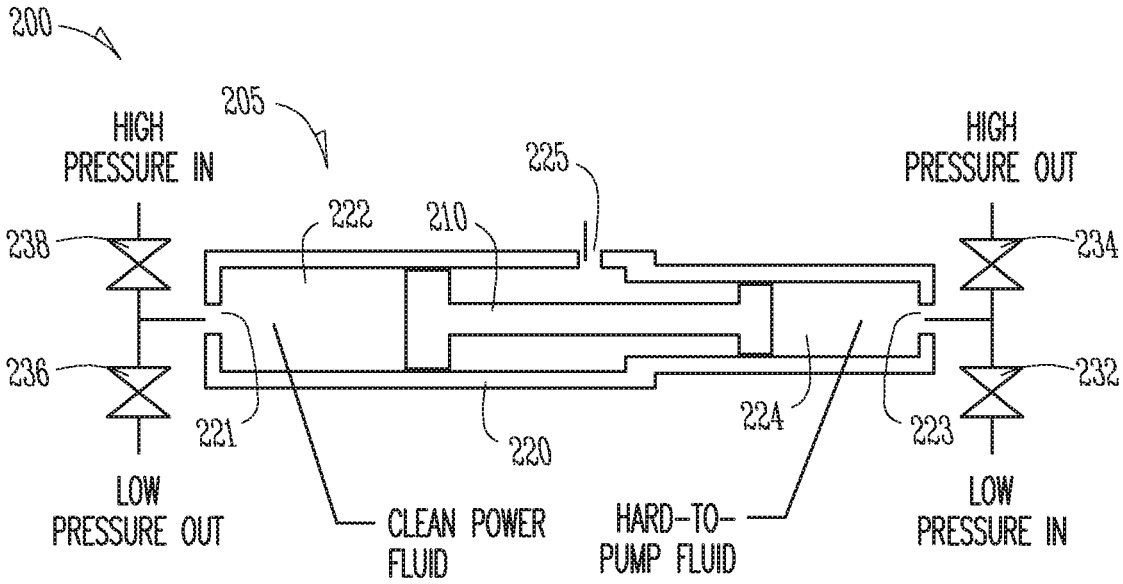
FIG. 2 is schematic of an example apparatus to pump diverter and other hard-to-pump materials for operations in a wellbore, in accordance with various embodiments.

FIG. 2 is schematic representation of an embodiment of an example apparatus 200 to pump diverter and other hard-to-pump materials. The hard-to-pump materials can be implemented, for example, for operations in a wellbore. Hard-to-pump materials can include large pebbles, large cloth material, strings, and other similar items, which could be stuck when a valve is being closed in conventional pumping systems. The apparatus 200 can include an injector device 205 having a housing 220 and a movable member 210 operable in a reciprocating motion in a driver side 222 and a suction or injection side 224 of the housing 220. The movable member 210 can be realized by a piston, a plunger, or other similar component. The injector device 205 can also have an inlet 225 to the housing 220 to provide a control fluid to the motion of the movable member 210. The driver side 222 can have a diameter greater than the diameter of the suction/injection side 224 such that an area ratio of the driver side 222 to the suction/injection side 224 is sufficient to overcome friction in the injector device 205 to move the movable member 210 to the suction/injection side 224 in response to power fluid supplied into the driver side 222.

The apparatus 200 can include a number of valves to regulate the operation of the injector device 205. A first set of valves, such as valves 232 (for example, valve B of FIG. 3) and 234 (for example, valve A of FIG. 3), can be coupled to a port 223 of the suction side 224 of the housing 220 to regulate discharge of material with respect to a low pressure input and a high pressure output. The low pressure may be typically, but not limited to, pressures in the range of 50 to 100 psi. The high pressure may be typically, but not limited to, pressures in the range of from 1,000 psi up to 30,000 psi. The valves 232 (for example, valve B of FIG. 3) and 234 (for example, valve A of FIG. 3) can be coupled to the suction side 224 of the housing 220 to regulate discharge of material from a mixing tank to a wellbore or a static mixer, for example. A second set of valves, such as valves 236 (for example, valve G of FIG. 3) and 238 (for example, valve F of FIG. 3), can be coupled to a port 221 of the driver side 222 of the housing 220 to regulate supply and removal of fluid with respect to a low pressure input and a high pressure output. For example, the valves 236 and 238 can be coupled to the driver side 222 of the housing 220 to regulate supply and removal of power fluid from the driver side 222. The valve 238 coupled to high pressure in can be arranged to operatively receive the supply of the power fluid from a pumping source of fluid to a wellbore. The valve 238 can be coupled to a high horsepower treating pump (not shown in FIG. 2, but shown for example as 345 in FIG. 3) arranged so as to typically pump fluids directly from about a 100 psi up to the treating pressure, which is the high pressure into the valve 238. Positive displacement plunger type pumps can be used, such as but not limited to a quintuplex type pump. High pressure pumps can be used that have structure or form other than plunger pumps, where such pumps can include, but are not limited to, centrifugal, piston, or other high pressure pumps. Though not shown in FIG. 2, a third set of valves can be coupled to the inlet 225 of the housing 220 to regulate supply and removal of control fluid. A valve of the third set can be arranged to operatively receive the supply of the control fluid from the pumping source of fluid to a wellbore. The apparatus 200 provides a combination of valves working together to pump hard-to-pump materials.

Figure 3:
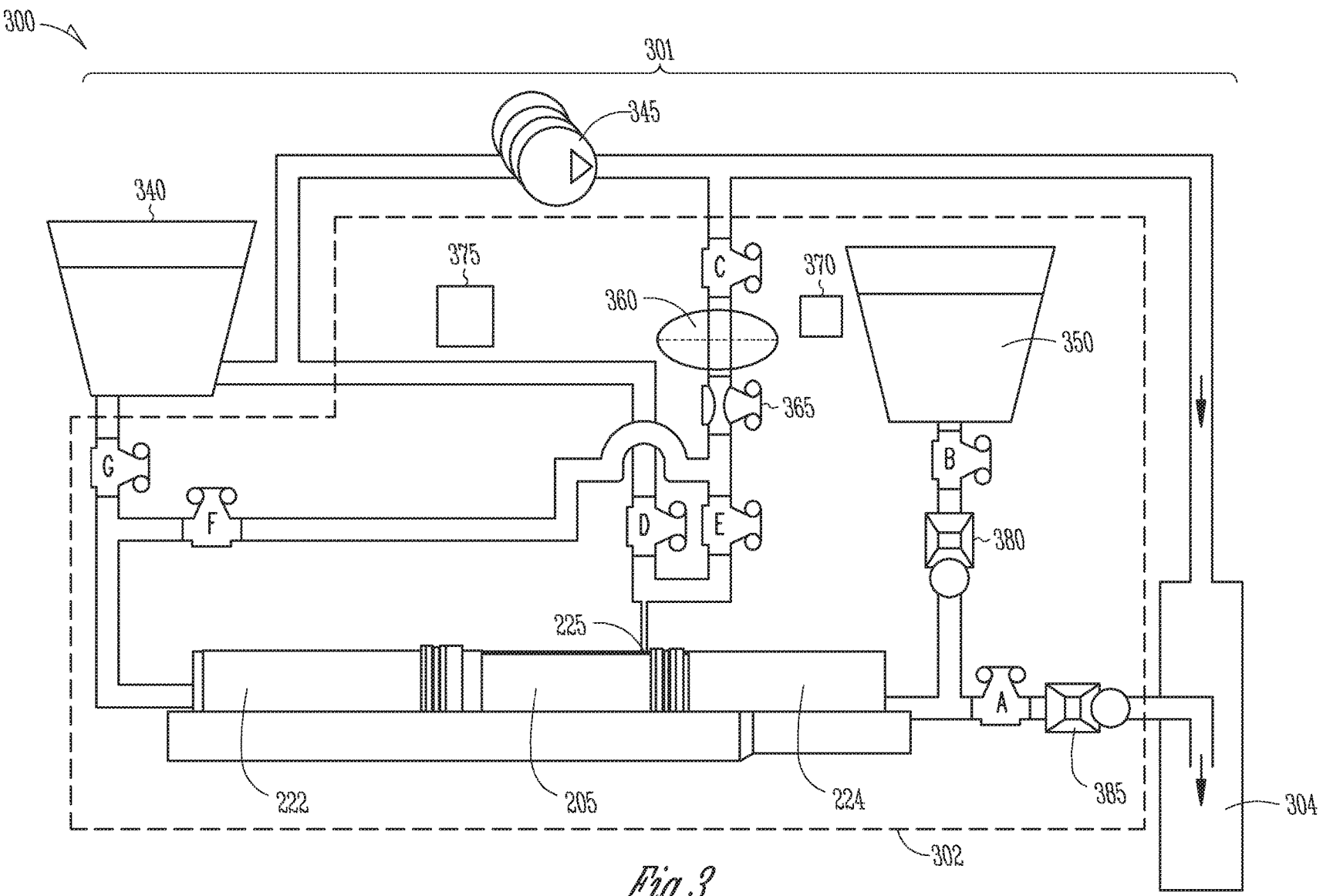
FIG. 3 is an example system using high pressure fluid to pump difficult substances into a wellbore, in accordance with various embodiments.

FIG. 3 is an embodiment of an example system 300 using high pressure fluid to pump difficult substances into a wellbore 304. The high pressure fluid can be frac fluid. The system 300 may be varied using components from similar configurations known in the industry. System 300 can include an injector device such as the injector device 205 of FIG. 2. As discussed above, the driver side 222 can have a diameter greater than the diameter of the suction side 224 such that an area ratio of the driver side 222 to the suction side 224 is sufficient to overcome friction in the injector device 205 to move the movable member 210 of the injector device 205 to the suction side 224 in response to power fluid supplied into the driver side 222.

In general, the system 300 can actually be separated into two parts. One part is system 301, which includes tank 340, high pressure pump 345, and wellbore 304. This part is the fracturing pump system generally used to fracture stimulate the formation through the wellbore 304. The other part is the difficult to inject material that is contained in the mixing tank 350. Note that, if the material is not difficult to inject, then the content of mixing tank 350 can be simply mixed as needed into tank 340. The other part is the injection system 302 that may include the injector device 205 arranged with a mixing tank 350, and a number of valves to control injection of fluid into the wellbore 304. In system 301, the fluid source 340 can be arranged to operably contain fluid and can be coupled to the set of high pressure pumps 345, where the set of high pressure pumps 345 can be arranged to operatively pump a portion of the fluid from the fluid source 340 to the wellbore 304. The fluid source 340 can be a blender. A blender is a machine that prepares treatment fluids. The blender 340 may include a centrifugal pump in some embodiments. The set of high pressure pumps 345 can be at least one high pressure pump 345. The set of high pressure pumps 345 may be realized by a set of frac pumps. The set of frac pumps can be arranged as one or more frac pumps. The mixing tank 350 can be arranged to operably contain material to be added to the wellbore 304. The material in the mixing tank 350 can be special fluid for a given application. If the special fluid is difficult to inject, the injector device 205 in the system 302 can use treatment fluid from the fluid source 340 as power fluid to inject material into a path to the wellbore 304, the injected material being special fluid to add to the treatment fluid entered into the wellbore 304. The injector device 205 in the system 300 can use treatment fluid from the fluid source 340 as control fluid to control a suction stroke of the movable member 210 of the injector device 205.

The system 302 can include valves A to G. The valves A to G can be realized as rotary valves. These valves may be manually operated valves. Alternatively, the valves A to G can be hydraulically actuated valves (actuator not shown for simplicity). Note that valves D and G are parallel connected to either the blender 340 or the suction of pumps 345. A first set of valves, such as valves A and B, can be coupled to the suction side 224 of the housing of the injector device 205 to regulate discharge of material from the mixing tank 350 to the wellbore 304 or a static mixer. The valve B can be coupled to the mixing tank 350 with the valve A coupled to the suction side 224 of the injector device 205. Anyone skilled in the art may notice that theoretically, downstream side of valve A and the upstream side of valve C are both connected to the downstream side of pump 345. While in theory the two valves can be tied in together to the high pressure line to the wellbore, it is highly recommended that the connection from valve A is downstream from the connection of valve C, so that filter 360 is not contaminated by material from mixing tank 350.

A second set of valves, such as valves G and F, can be coupled to the driver side 222 of the housing of the injector device 205 to regulate supply and removal of power fluid from the driver side 222. The valve F can be coupled to high pressure in to operatively receive the supply of the power fluid from the set of high pressure pumps 345 that also pump fluid to the wellbore 304. A third set of valves, such as valves D and E, can be coupled to the inlet 225 of the housing of the injector device 205 to regulate supply and removal of control fluid. The valve E can be arranged to operatively receive the supply of the control fluid from the set of high pressure pumps 345. The valve E can act as a high pressure supply in to activate the suction stroke of the injector device 205. The system 300 can include a controller 375 to control hydraulic activation of valves of the first set of valves (A and B), the second set of valves (F and G), and the third set of valves (D and E) in accordance with a timing sequence.

The system 300 can include a variable choke 365 disposed between the set of high pressure pumps 345 and the valve F of the second set arranged to operatively receive supply of the power fluid from the set of high pressure pumps 345 and between the set of high pressure pumps 345 and the valve E of the third set arranged also to operatively receive supply of the control fluid from the set of high pressure pumps 345. The variable choke 365 may be hydraulically regulated. A controller 370 can be arranged to regulate the variable choke 365 to regulate injection flow rate. The controller 370 and the controller 375 may be arranged as a single component or two components. The controller 370 and the controller 375, in either case, may comprise a number of distributed devices. The controllers 370 and 375 can include one or more processors.

The system 300 can include a set of filters 360 between the set of high pressure pumps 345 and the variable choke 365. The set of filters can be arranged as one or more filters. The set of filters 360 can be structured as high pressure filters. The set of filters 360 may be a bank of a plurality of filters that can be automatically back-flushed one at a time.

The system 300 can include a safety system to prevent accidental flow back. The safety system can include a first check valve 380 disposed between the valve B of the first set of valves and the suction side 224 of the housing of the injector device 205 and a second check valve 385 disposed between the valve A of the first set of valves and the wellbore 304. The system 300 can include a valve C selectable to shut down operation of the injector device 205.

The valve A connects the discharge of the injector device 205 to either the wellbore 304 or, optionally, to a static mixer above the wellhead. Fluid in the cylinder chamber of the injector device 205 can be pushed out at the rate determined by the variable choke 365. Since the pressure differential across the variable choke 365 is small (about $1/8^{th}$ of the well pressure) and the area 222 of the injection device 205 is large, the choke can be easily regulated so that the injection rate is relatively slow. With the same choke, the return rate would be far greater, because of the small annular area outside the injection device 205, so this device can be ready for the next stroke quickly. The valve B connects the mixing tank 350, which can be arranged as a special fluid blender tub 350, to the suction side 224 of the cylinder of the injector device 205. The special fluid can be hard-to-pump fluid. These two valves, A and B, provide a pathway from the high pressure wellbore 304 to the special fluid blender tub 350. The two check valves 380 and 385 can be placed to provide a safe, quadruple sealing for optimum redundancy. Note that the two check valves 380 and 385 functionally can satisfy the operation of this portion of the system 300.

The valve C does not have any functional purpose with respect to injecting or removing fluid, other than shutting down the system. The valves D and F are open in the forward motion of the movable member 210 of the injector device 205, and closed otherwise. Valves E and G are open during the suction operation. Care must be given to insure that valves D and F are not open at the same time as valves E and G. To do this safely, the switching can follow the state diagram shown in FIG. 4. Though all the valves may be electronically controlled, it may not be appropriate to attempt to switch all the relevant valves together from injection state to suction state. For example, if valve B opens up 1 microsecond prior the closure of valve A, then 15,000 psi will be open to the fluid source 340, which probably is not enough to cause a blow up, but an undesired reaction might happen. In addition, since the opening and closing of the valves is not instantaneous, attempting to switch all the relevant valves may result in a disastrous event. Note also that at the initiation of injection, valve A is activated last (see last line of the timing sequence 403 of FIG. 4), and the suction is started by valve E. The timing sequence 403 provides a procedure for conducting one action to be performed and completed before the next action is started.

Figures 4, 5:
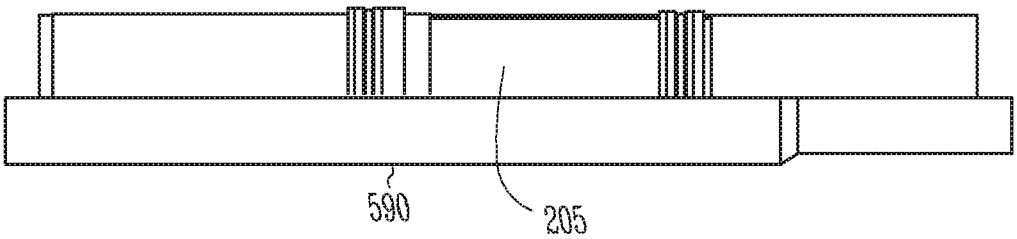
FIG. 4 is a state diagram of a sequence of opening and closing valves of the system of FIG. 3, in accordance with various embodiments.
FIG. 5 is a schematic of injector device of FIG. 2 with an outer sleeve around the housing of the injector device, in accordance with various embodiments.

In FIG. 4, the sequence 403 of opening and closing valves of the system 300 is shown with 0 for a respective valve being closed and with 1 for a respective valve being open. The system 300 or similar systems allow material that doesn't pump through the set of high pressure pumps 345 easily to be injected in the wellbore 304. The hard-to-pump material can be supplied as a special mixture, which can include fluids and solids, in mixing tank 350, below which is the valve B. The special mixture can be injected into the well bore 304 without being pumped through the set of high pressure pumps 345. The valve B can provide a way to a control injection into the wellbore 304 via the injector device 205. Opening the valve B enables the special mixture to go into the injector device 205 from the mixing tank 350. The valve B is opened, and the suction stroke of the injector device 205 is activated. The check valve 380 can be used with the valve B to prevent high pressure from flowing in.

The valve C can be opened to enable fluid from the set of high pressure pumps 345 to then optionally pass through the set of filters 360 to limit the particulate matter that might be in the frac fluid. The fluid, which flows from the set of high pressure pumps 345 and then through the set of filters 360, can be conveyed through the variable choke 365, where the variable choke 365 can be used to control the speed of the stroke of the injector device 205. The variable choke 365 acts as a speed control.

At this point in the sequence, there is a choice of either enacting a discharge stroke, in which case the valve F is opened, or enacting a suction stroke, in which case the valve D is closed and the valve E is opened.

With high pressure fluid flowing through the variable choke, the valve F or the valve E can be actuated, depending on whether a discharge stroke or a suction stroke of the injector device 205 is to be actuated. For a suction stroke, the valve G is opened, which allows fluid that is in the driver side 222 of the injector device 205 to return to the fluid source 340, because now the valve E is opened to introduce high pressure fluid into the center port 225. Introduction of the high pressure fluid into the center port 225 pushes the movable member 210 to the left away from the suction side 224 of the injector device 205. So the fluid in the driver side 222 is flowed through the valve G to return to the fluid source 340.

During this suction stroke, the valve F is closed, and the movable member 210 is driven all the way to the left away from the suction side 224. While the movable member 210 moves to the left, the injector device 205 sucks in fluid, which is the special fluid from the mixing tank 350, filling the suction side 224 with the special fluid. Once the movable member 210 moves all the way to the left, the valves are then reconfigured to prepare for a discharge stroke. The valve B is closed and the valve A is opened, high pressure fluid is diverted from the variable choke 365 through the valve F with the valve G closed to prevent fluid from going to the fluid source 340. The driver side 222 of the injector device 205 is being pressurized. Now, at this point, the fluid that input with the valve E to perform the suction stroke is to be conveyed somewhere. To accomplish this conveyance, the valve D lets the exhausted fluid in the center of the injector device 205 to go back to the fluid source 340 via the inlet 225.

With the valve D open and fluid energized through the valve F, the movable member 210 is driven to the right away from the driver side 222 of the injector device 205. The high pressure fluid, which is pumped in, for example by the set of high pressure pumps 345, is now in the driver side 222 of the injector device 205. Because the driver side 222 is slightly larger than the suction side 224, the movable member 210 is urged to the right away from the driver side 222. The sizing of the driver side 222 and the suction side 224 is not necessarily intended to be a pressure intensification device. The sizing can be realized for the area ratio between the two sides to be sufficient to overcome the friction that is in the injector device 205 such that there is a positive urging, generating a motion moving the movable member 210 to the right hand side away from the driver side 222.

With the movable member 210 moving to the right by the fluid moving through the valve F, fluid is forced out of the valve A and into the well bore 304. The movable member 210 moves all the way to the right to complete the discharge stroke. Then, the procedure can start over, with fluid introduced back in the center inlet 225 to actuate another suction stroke, and the procedure can continue repeatedly. Alternatively, the procedure can be conducted once.

FIG. 5 is a schematic of injector device 205 of FIG. 2 with an outer sleeve 590 around the housing of the injector device 205. Adding a couple of sleeves as an additional feature can be implemented so that stresses inside the injector device 205 can be reduced by pumping some pressure outside the injector device 205 by operatively pumping conditioning fluid outside the injector device 205. Reducing stress in such a manner may improve life of the injector device 205. If this pumping feature is not used, the sleeve 590 can be used to provide heating of the injector device 205 when operating in cold regions.

Systems, such as system 300 including an embodiment of an injector device 205, as taught herein, can help pump typically un-pumpable fluids that the oil and gas industry has to deliver downhole. Large proppants, or long ones, can be pumped essentially without an issue using such an injector device. Since valve A and B relates primarily to the difficult proppants, they must be strong enough to break or crush the proppants during the slow closure process. The injector pump system is a unique self-injecting pump system, which can be powered by a wellbore or frac pressure, for example; so no additional equipment is required except for the pump unit itself. Essentially, in operation of this injector pump system, the injector pump system can be implemented to connect its output to the high pressure line or the well, and connect its input to the fluid supply. In the example system 300, the high pressure fluid is "dumped" back into the blender and is replaced by 80%-90% volume of the replacement fluid. The 10-20% inefficiency is caused by seal friction, which means that injector pumps with larger plungers and higher pressures are more efficient.

Figure 6:
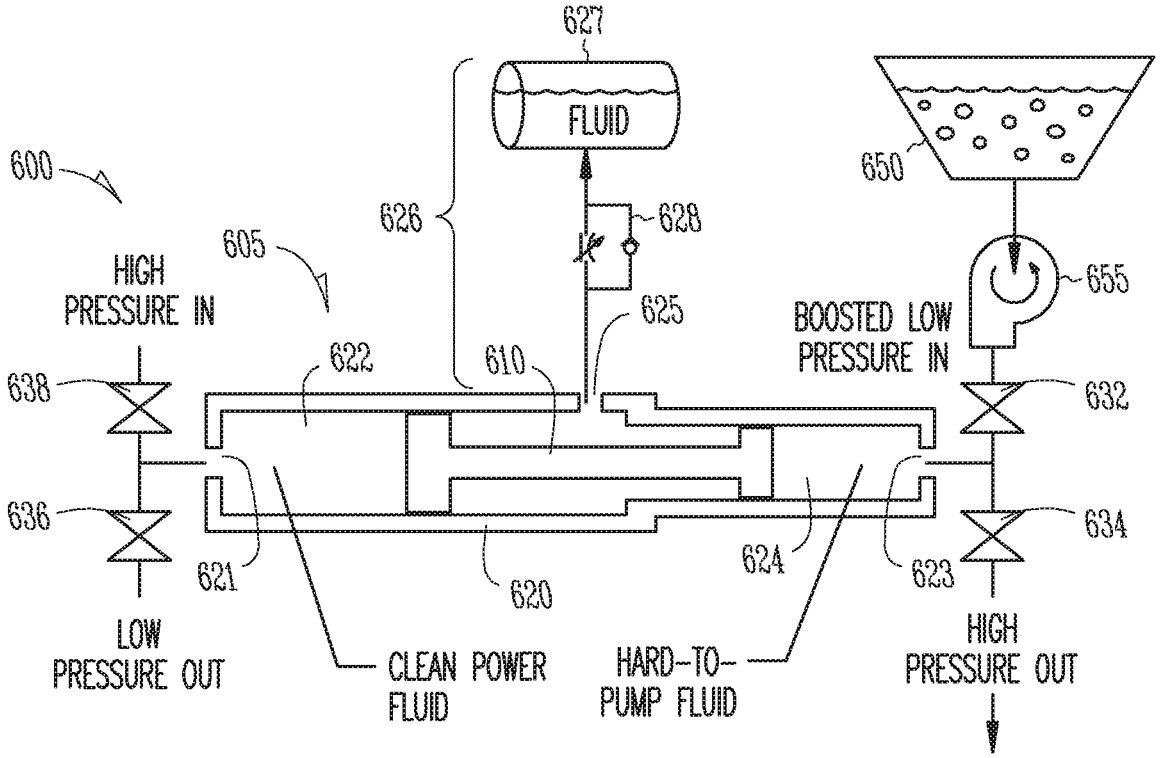
FIG. 6 is a schematic representation of another example apparatus to pump diverter and other hard-to-pump materials, in accordance with various embodiments.

FIG. 6 is a schematic representation of an embodiment of another example apparatus 600 to pump diverter and other hard-to-pump materials. The hard-to-pump materials can be implemented, for example, for operations in a wellbore, Hard-to-pump materials can include large pebbles, large cloth material, strings, and other similar items, which could be stuck when a valve is being closed in conventional pumping systems. The apparatus 600 can include an injector device 605 having a housing 620 and a movable member 610 operable in a reciprocating motion in a driver side 622 and a suction side 624 of the housing 620. The movable member 610 can be realized by a piston, a plunger, or other similar component. The driver side 622 can have a diameter greater than the diameter of the suction side 624 such that an area ratio of the driver side 622 to the suction side 624 is sufficient to overcome friction in the injector device 605 to move the movable member 610 to the suction side 624 in response to power fluid supplied into the driver side 622.

The injector device 605 can also have a center port 625 to the housing 620 optionally coupled to a passive metering system 626 or arranged as a vent. The passive metering system 626 may include a reservoir 627 for containing fluid and variable control valves 628 to meter the flow of the fluid. The passive metering system 626 coupled to the center port 625 can be used for metering fluid for the strokes of the movable member 610. The suction stroke, the drive stroke, or both the suction and drive strokes can be metered, although in FIG. 6, control valve 628 only meters the injection stroke. The suction stroke is only determined by the ability of the pump 655 to supply the needed volume of fluid.

The apparatus 600 can include a number of valves to regulate the operation of the injector device 605. A first set of valves, such as valves 632 (for example, valve B of FIG. 7) and 634 (for example, valve A of FIG. 7), can be coupled to a port 623 of the suction side 624 of the housing 620 to regulate discharge of material with respect to a low pressure input and a high pressure output. The low pressure may be typically, but not limited to, pressures in the range of 50 to 100 psi. The high pressure may be typically, but not limited to, pressures in the range of from 1,000 psi up to 30,000 psi. The valves 632 (for example, valve B of FIG. 7) and 634 (for example, valve A of FIG. 7) can be coupled to the suction side 624 of the housing 620 to regulate discharge of material from a mixing tank 650 to a wellbore or a static mixer, for example.

A second set of valves, such as valves 636 (for example, valve G of FIG. 7) and 638 (for example, valve F of FIG. 7), can be coupled to a port 621 of the driver side 622 of the housing 620 to regulate supply and removal of fluid with respect to a low pressure input and a high pressure output. For example, the valves 636 and 638 can be coupled to the driver side 622 of the housing 620 to regulate supply and removal of power fluid from the driver side 622. The valve 638 coupled to high pressure in can be arranged to operatively receive the supply of the power fluid from a pumping source of fluid to a wellbore. The valve 638 can be coupled to a high horsepower treating pump (not shown in FIG. 6, but shown for example as 745 in the example of FIG. 7) arranged so as to typically pump fluids directly from about a 100 psi up to the treating pressure, which is the high pressure into the valve 638. Positive displacement plunger type pumps can be used, such as but not limited to a quintuplex type pump.

The apparatus 600 provides a combination of valves working together to pump hard-to-pump materials. The hard-to-pump materials can be disposed in the mixing tank 650 that is coupled to the valve 632 by a boost pump 655. The difficult-to-pump material can be boosted by boost pump 655, which could be used to drive the suction stroke (retraction) directly when valve 636 is open to pressure return, without a powered suction stroke. When valve 636 is opened to pressure return, this activation enables fluid to exit the driver side 622. The pressure return may be at a lower pressure. The lower pressure may be atmospheric pressure. This provides an alternative structure and technique to using the center port 225 of apparatus 200 of FIG. 2 and system 300 of FIG. 3 to drive the suction stroke. If check valves (passive valves) are used in valves 632 and 634, then the operation becomes actuating valves 638 and 636 in an alternating open/close sequence to run the injection device 605. Valves 638 and 636 provide an active valve drive system. The valves 632 and 634 may also be realized by active valves.

Figure 7:
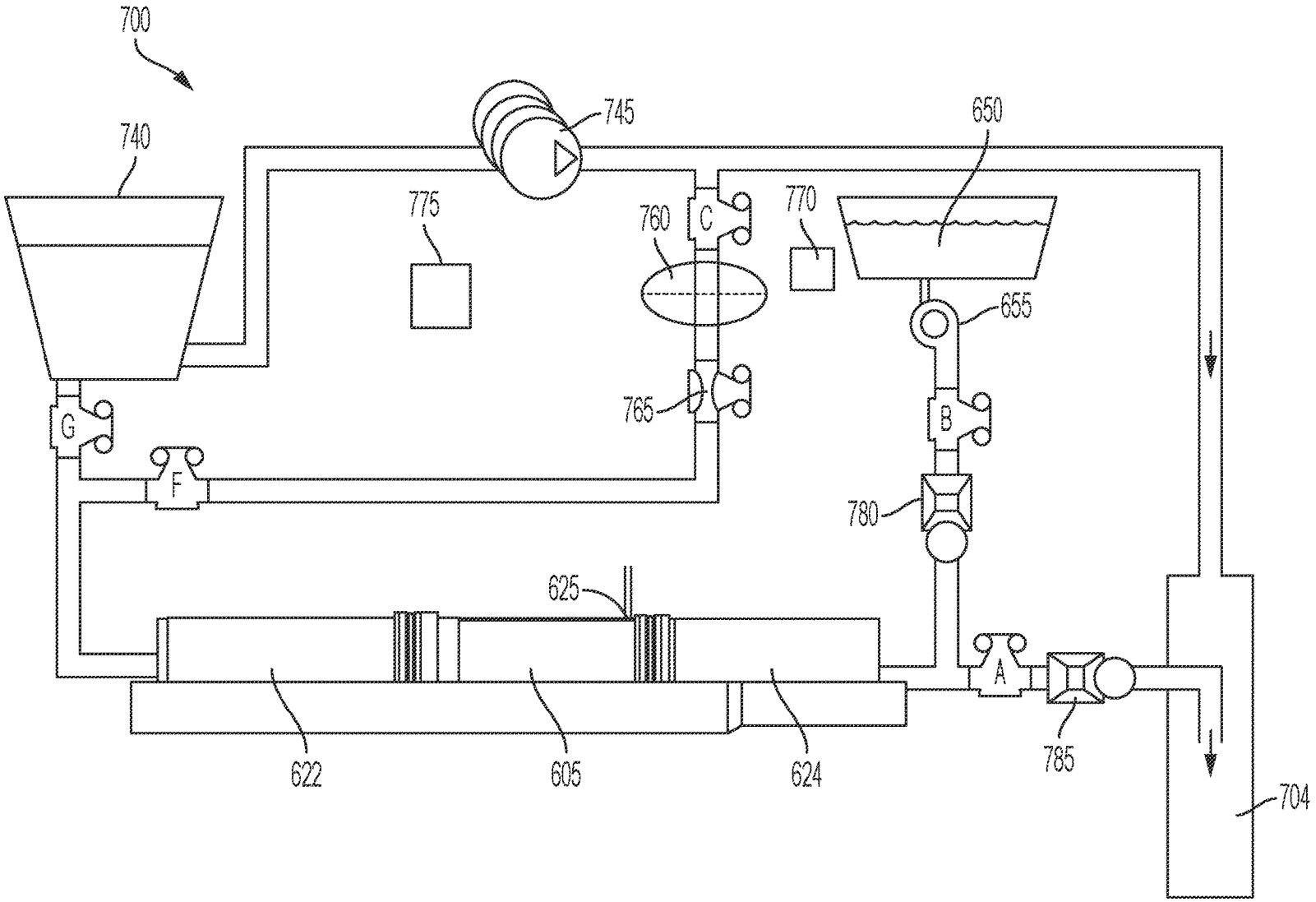
FIG. 7 is an example system using high pressure fluid to pump difficult substances into a wellbore, in accordance with various embodiments.

FIG. 7 is an embodiment of an example system 700 using high pressure fluid to pump difficult substances into a wellbore 704. The high pressure fluid can be frac fluid. The system 700 may be varied using components from similar configurations known in the industry. System 700 can include an injector device such as the injector device 605 of FIG. 6. As discussed above, the driver side 622 can have a diameter greater than the diameter of the suction side 624 such that an area ratio of the driver side 622 to the suction side 624 is sufficient to overcome friction in the injector device 605 to move the movable member 610 of the injector device 605 to the suction side 624 in response to power fluid supplied into the driver side 622.

The system 700 can include the injector device 605 arranged with a fluid source 740, a mixing tank 650, a boost pump 655, a set of high pressure pumps 745, and a number of valves to control injection of fluid into the wellbore 704. The fluid source 740 can be arranged to operably contain fluid and can be coupled to the set of high pressure pumps 745, where the set of high pressure pumps 745 can be arranged to operatively pump a portion of the fluid from the fluid source 740 to the wellbore 704. The fluid source 740 can be a blender. The blender 740 may include a centrifugal pump in some embodiments. The set of high pressure pumps 745 can be at least one high pressure pump 745. The set of high pressure pumps 745 may be realized by a set of frac pumps. The set of frac pumps can be arranged as one or more frac pumps. The mixing tank 650 can be arranged to operably contain material to be added to the wellbore 704. The material in the mixing tank 650 can be special fluid for a given application. The injector device 605 in the system 700 can use treatment fluid from the fluid source 740 as power fluid to inject material into a path to the wellbore 704, the injected material being special fluid to add to the treatment fluid entered into the wellbore 704. The injector device 605 may also have a center port 625 to the housing 620 arranged as a vent, which can be used for leak detection for both packing/piston seals. Another option, as shown in FIG. 6, center port 625 can be coupled to a passive metering system.

The system 700 can include valves A to G. The valves A to G can be realized as rotary valves. These valves may be manually operated valves. Alternatively, the valves A to G can be hydraulically actuated valves (actuator not shown for simplicity). Valves A and B can be arranged similar to the first set of valves, 634 and 632, respectively of the apparatus 600 of FIG. 6. Valve B is coupled to the mixing tank 650 via the boost pump 655. A second set of valves, such as valves G and F, can be can be arranged similar to the second set of valves, 636 and 638, respectively of the apparatus 600 of FIG. 6. The valve F can be coupled to high pressure in to operatively receive the supply of the power fluid from the set of high pressure pumps 745 that also pump fluid to the wellbore 704.

The system 700 can include a controller 775 to control hydraulic activation of valves of the first set of valves (A and B) and the second set of valves (F and G) in accordance with a timing sequence. The system 700 can also include a variable choke 765 disposed between the set of high pressure pumps 745 and the valve F of the second set arranged to operatively receive supply of the power fluid from the set of high pressure pumps 745. The variable choke 765 may be hydraulically regulated. A controller 770 can be arranged to regulate the variable choke 765 to regulate injection flow rate. The controller 770 and the controller 775 may be arranged as a single component or two components. The controller 770 and the controller 775, in either case, may comprise a number of distributed devices. The controllers 770 and 775 can include one or more processors.

The system 700 can include a set of filters 760 between the set of high pressure pumps 745 and the variable choke 765. The set of filters can be arranged as one or more filters. The set of filters 760 can be structured as high pressure filters. The set of filters 760 may be a bank of a plurality of filters that can be automatically back-flushed one at a time.

The system 700 can include a safety system to prevent accidental flow back. The safety system can include a first check valve 780 disposed between the valve B of the first set of valves and the suction side 624 of the housing of the injector device 605 and a second check valve 785 disposed between the valve A of the first set of valves and the wellbore 704. The system 700 may optionally include a valve C selectable to shut down operation of the injector device 605. The valve C does not have any functional purpose with respect to injecting or removing fluid, other than shutting down the system.

The valve A connects the discharge of the injector device 605 to either the wellbore 704 or, optionally, to a static mixer above the wellhead. Fluid in the cylinder chamber of the injector device 605 can be pushed out at the rate determined by the variable choke 765. With the pressure differential across the variable choke 765 small (about $1/8^{th}$ of the well pressure), the injection rate is relatively slow. With the same choke, the return rate would be far greater, so this device can be ready for the next stroke quickly. The valve B connects the mixing tank 650, which can be arranged as a special fluid blender tub 650, to the suction side 624 of the cylinder of the injector device 605. The special fluid can be hard-to-pump fluid. These two valves, A and B, provide a pathway from the high pressure wellbore 704 to the special fluid blender tub 650. The two check valves 780 and 785 can be placed to provide a safe, quadruple sealing for optimum redundancy. Note that the two check valves 780 and 785 functionally can satisfy the operation of this portion of the system 700.

Figure 8:
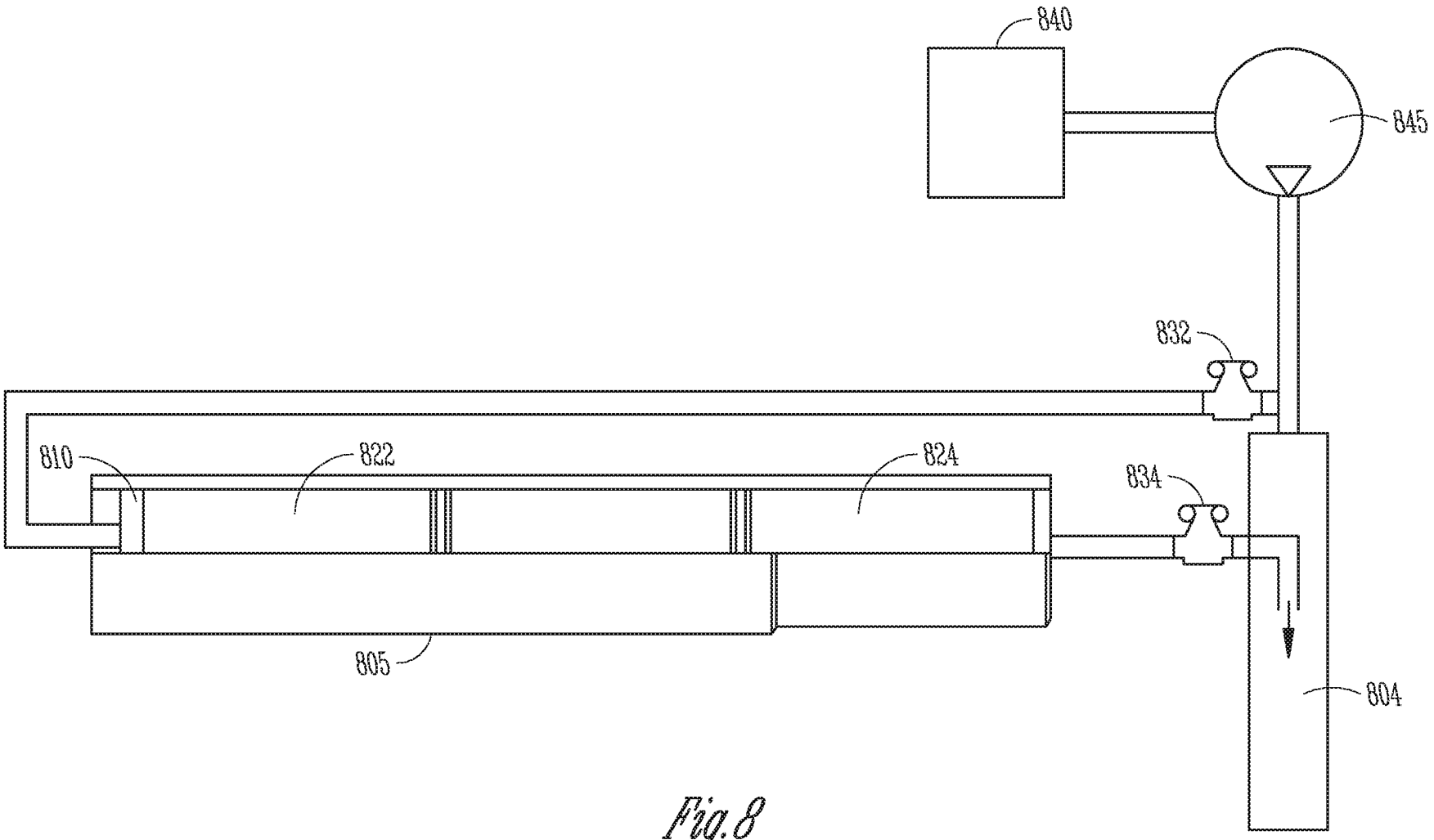
FIG. 8 is an example system using high pressure fluid to pump difficult substances into a wellbore, in accordance with various embodiments.

FIG. 8 is an embodiment of an example system 800 using high pressure fluid to pump difficult substances into a wellbore 804. The high pressure fluid can be frac fluid. The system 800 may be varied using components from similar configurations known in the industry. System 800 can include an injector device 805 having a movable member 810. The injector device 805 includes a driver side 822, which can have a diameter greater than the diameter of an injection side 824 such that an area ratio of the driver side 822 to the injection side 824 is sufficient to overcome friction in the injector device 805 to move the movable member 810 of the injector device 805 to the injection side 824 in response to power fluid supplied into the driver side 822. The injection side 824 can be arranged as a chamber to contain the difficult substances to be injected into the wellbore. The chamber can be connected to a mixing tank for the difficult substances.

The system 800 can include a set of high pressure pumps 845, and a number of valves to control injection of fluid into the wellbore 804. The set of high pressure pumps 845, where the set of high pressure pumps 845 can be arranged to operatively pump a portion of the fluid from a fluid source 840 to the wellbore 804. The fluid source 840 can be a blender. The blender 840 may include a centrifugal pump in some embodiments. The set of high pressure pumps 845 can be at least one high pressure pump 845. The set of high pressure pumps 845 may be realized by a set of frac pumps. The set of frac pumps can be arranged as one or more frac pumps.

The system 800 can include valves 832 and 834. The valves 832 and 834 can be realized as rotary valves. These valves may be manually operated valves. Alternatively, the valves valves 832 and 834 can be hydraulically actuated valves (actuator not shown for simplicity). The system 800 may work as a single shot injection. For example, valve 834 can be opened, and valve 832 can be "cracked" open to slowly inject from the chamber 824, which can be prefilled with difficult substance. Optionally, the chamber 824 can be refilled manually.

Figure 9:
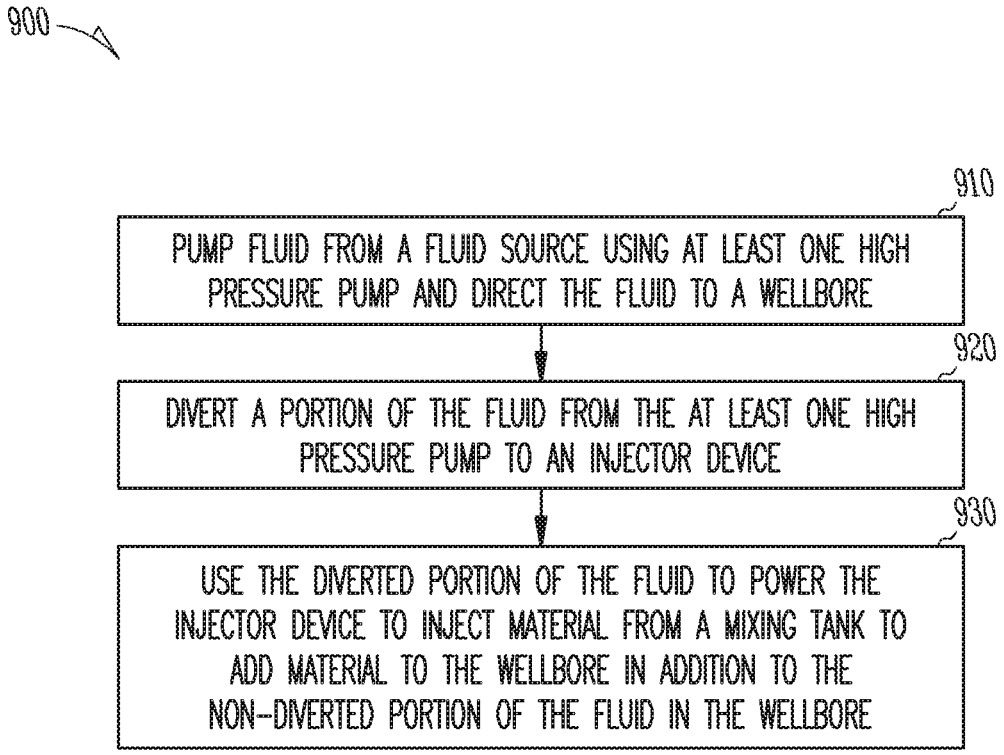
FIG. 9 is a flow diagram of features of an example method of using high pressure fluid to pump difficult substances, in accordance with various embodiments.

FIG. 9 is a flow diagram of features of an example embodiment of a method 900 of using high pressure fluid to pump difficult substances. At 910, fluid is pumped from a fluid source using at least one high pressure pump and is directed to a wellbore. The fluid source may be a blender. The at least one high pressure pump may be realized by a set of frac pumps. The set of frac pumps may include one or more frac pumps.

At 920, a portion of the fluid from the at least one high pressure pump is diverted to an injector device. The non-diverted portion of the fluid can enter the wellbore. Diverting the portion of the fluid from the at least one high pressure pump to the injector device can include coupling the diverted portion of the fluid to two ports of a housing of the injector device, where one of the two ports to power a suction stroke and the other port of the two ports to control injection.

At 930, the diverted portion of the fluid is used to power the injector device to inject material from a mixing tank to add material to the wellbore in addition to a non-diverted portion of the fluid in the wellbore. Using the diverted portion of the fluid to power the injector device to inject material from the mixing tank can include operating valves coupled to the injector device to pull the material from the mixing tank using a suction stage of the injector device and to inject the material into the wellbore using an injection stage of the injector device. Using the suction stage of the injector device may include moving a member of the injector device from a suction side of a housing of the injector device to a driver side of the housing and using the injection stage of the injector device may include moving the member from the driver side of the housing to the suction side of the housing. The member of the injector device may be realized by a piston-like component, a plunger-like component, or similar structure.

Variations of method 900 or methods similar to method 900 can include a number of different embodiments that may or may not be combined depending on the application of such methods and/or the architecture of systems in which such methods are implemented. Such methods can include controlling activation of the valves used in the procedure in accordance with a timing sequence. The activation may be made as a hydraulic activation or other appropriate activation. The timing sequence can be defined to operate the injection without accidental pressure releases during its operation. Such methods may include using the diverted portion of the fluid to power the injector device to include operating an injector device having a movable member operable in a reciprocating motion in a driver side and a suction side of a housing of the injector device and having an inlet to the housing to provide a control fluid to motion of the movable member, the driver side having a first diameter and the suction side having a second diameter, the first diameter being greater than the second diameter such that an area ratio of the driver side to the suction side is sufficient to overcome friction in the injector device to move the movable member to the suction side in response to power fluid supplied into the driver side.

Variations of method 900 or methods similar to method 900 can include boosting the material by a boost pump to drive a suction stroke directly when a valve to the injector device is open to pressure return. Such methods can include metering fluid through a port in a middle portion of the injector device for use in a suction stroke and/or drive stroke of the injector device.

In various embodiments, apparatus and methods, as taught herein, can provide for the separation of difficult-to-pump material into a concentrated slurry, associated with a much lower pumping rate. The liquid can be squeezed through an opening and valve, as a large volume at one time, with no valve action. A valve closure can be conducted after the large volume is conveyed, using a positively closing valve such as using a powerful closing valve system. Such techniques can allow for placement of difficult-to-pump fluids, where such fluids are additional fluids and do not constitute a primary treatment fluid. Such fluids can include pump diverters or similar fluids that only are used for a short time during the treatment of well. Such apparatus and methods may be implemented with low total volume. Apparatus and methods that provide for use of frac fluid pressure to pump difficult substances may allow for avoidance of costly pump valve failures due to material wedging on valve seats, causing massive erosion on the valves and seats, and leading to enhanced revenue stream, repeat operations providing additional revenues, and significant maintenance cost savings.

The following are example embodiments of methods, systems, and machine readable storage devices, in accordance with the teachings herein.

A method 1 can comprise: pumping fluid from a fluid source using at least one high pressure pump and directing the fluid to a wellbore; diverting a portion of the fluid from the at least one high pressure pump to an injector device; and using the diverted portion of the fluid to power the injector device to inject material from a mixing tank to add material to the wellbore in addition to a non-diverted portion of the fluid in the wellbore.

A method 2 can include elements of method 1 and can include diverting the portion of the fluid from the at least one high pressure pump to the injector device to include coupling the diverted portion of the fluid to two ports of a housing of the injector device, one of the two ports to power a suction stroke and the other port of the two ports to control injection.

A method 3 can include elements of any of methods 1 and 2 and can include using the diverted portion of the fluid to power the injector device to inject material from the mixing tank to include operating valves coupled to the injector device to pull the material from the mixing tank using a suction stage of the injector device and to inject the material into the wellbore using an injection stage of the injector device.

A method 4 can include elements of any of methods 1-3 can include controlling hydraulic activation of the valves in accordance with a timing sequence.

A method 5 can include elements of method 4 and elements of any of methods 1-3 can include the timing sequence being defined to operate the injection without accidental pressure releases during its operation.

A method 6 can include elements of method 3 and elements of any of methods 1-2 and 4-5 and can include using the suction stage of the injector device to include moving a member of the injector device from a suction side of a housing of the injector device to a driver side of the housing and using the injection stage of the injector device includes moving the member from the driver side of the housing to the suction side of the housing.

A method 7 can include elements of any of methods 1-6 and can include using the diverted portion of the fluid to power the injector device to include operating an injector device having a movable member operable in a reciprocating motion in a driver side and a suction side of a housing of the injector device and having an inlet to the housing to provide a control fluid to cause motion of the movable member, the driver side having a first diameter and the suction side having a second diameter, the first diameter being greater than the second diameter such that an area ratio of the driver side to the suction side is sufficient to overcome friction in the injector device to move the movable member to the suction side in response to power fluid supplied into the driver side.

A method 8 can include elements of any of methods 1-7 and can include boosting the material by a boost pump to drive a suction stroke directly when a valve to the injector device is open to pressure return.

A method 8 can include elements of method 7 and elements of any of methods 1-6 and can include metering fluid through a port in a middle portion of the injector device for use in a suction stroke and/or drive stroke of the injector device.

An apparatus 1 can comprise: an injector device capable of self-injecting material into a high pressure line, powered by pressurized fluid in the high pressure line.

An apparatus 2 can include elements of apparatus 1 and can include multiple valves to control recharge of material into the injector device and to control reinjection of the material into the high pressure line.

An apparatus 3 can include elements of any of apparatus 1 and 2 and can include the injector device having a movable member operable in a reciprocating motion in a driver side and a suction side of a housing of the injector device and having an inlet to the housing to provide fluid to cause motion of the movable member; a first set of valves coupled to the suction side of the housing to regulate discharge of material from a mixing tank to exterior to the injector device; a second set of valves coupled to the driver side of the housing to regulate supply and removal of fluid from the driver side; and a third set of valves coupled to the inlet of the housing to regulate supply and removal of fluid to control the motion of the movable member.

An apparatus 4 can include elements of any of apparatus 1-3 and can include the driver side having a first diameter and the suction side having a second diameter, the first diameter being greater than the second diameter such that an area ratio of the driver side to the suction side is sufficient to overcome friction in the injector device to move the movable member to the suction side in response to power fluid supplied into the driver side.

An apparatus 5 can include elements of any of apparatus 1-4 and can include an outer sleeve around the housing of the injector device.

An apparatus 6 can include elements of apparatus 5 and elements of any of apparatus 1-4 can include the outer sleeve arranged with the injector device to operatively pump conditioning fluid outside the injector device.

An apparatus 7 can include elements of apparatus 5 and elements of any of apparatus 1-4 and 6 and can include the outer sleeve arranged to operatively heat the injector device.

An apparatus 8 can include elements of any of apparatus 1-7 and can include a controller to control activation of valves of the first set of valves, the second set of valves, and the third set of valves in accordance with a timing sequence.

An apparatus 9 can include elements of any of apparatus 1-8 and can include a boost pump coupled to the injector device via a valve to boost the material from a mixing tank to drive a suction stroke directly when another valve to the injector device is open to pressure return.

A system 1 can comprise: a fluid source arranged to operably contain treatment fluid; at least one high pressure pump coupled to the fluid source and arranged to operatively pump a portion of the treatment fluid from the fluid source to a wellbore; a mixing tank arranged to operably contain material to add to the wellbore; an injector device having a movable member operable in a reciprocating motion in a driver side and a suction side of a housing of the injector device and having an inlet to the housing to provide fluid to control motion of the movable member; a first set of valves coupled to the suction side of the housing to regulate discharge of a portion of the material from the mixing tank to the wellbore or a static mixer; and a second set of valves coupled to the driver side of the housing to regulate supply and removal of treatment fluid from the driver side.

A system 2 can include elements of system 1 and can include the driver side having a first diameter and the suction side having a second diameter, the first diameter being greater than the second diameter such that an area ratio of the driver side to the suction side is sufficient to overcome friction in the injector device to move the movable member to the suction side in response to power fluid supplied into the driver side.

A system 3 can include elements of system 1 and elements of system 2 and can include the injector device having an inlet to the housing to provide fluid to control motion of the movable member and the system can include a third set of valves coupled to the inlet of the housing to regulate supply and removal of treatment fluid from the at least one high pressure pump to the injector device to control the motion of the movable member.

A system 4 can include elements of system 3 and elements of any of systems 1 and 2 and can include a controller to control activation of valves of the first set of valves, the second set of valves, and the third set of valves in accordance with a timing sequence.

A system 5 can include elements of system 3 and elements of any of systems 1, 2, and 4 and can include a variable choke disposed between the at least one high pressure pump and the valve of the second set arranged to operatively receive the supply of the power fluid from the at least one high pressure pump and between the at least one high pressure pump and the valve of the third set arranged to operatively receive the supply of the treatment fluid from the at least one high pressure pump to control the motion of the movable member.

A system 6 can include elements of system 5 and elements of any of systems 1-4 and can include a filter between the at least one high pressure pump and the variable choke.

A system 7 can include elements of system 5 and elements of any of systems 1-4 and 6 and can include a controller to regulate the variable choke to regulate the injection flow rate A system 8 can include elements of any of systems 1-7 and can include the first set of valves system to include a first valve of the first set of valves coupled to the mixing tank and a second valve of the first set of valves coupled to the suction side of the housing.

A system 9 can include elements of system 8 and elements of any of systems 1-7 and can include a safety system to prevent accidental flow back.

A system 10 can include elements of system 9 and elements of any of systems 1-8 and can include the safety system to include a first check valve disposed between the first valve of the first set of valves and the suction side of the housing and a second check valve disposed between the second valve of the first set of valves and the wellbore.

A system 11 can include elements of any of systems 1-10 and can include a shut down valve selectable to shut down operation of the injector device.

A system 12 can include elements of any of systems 1-11 and can include a boost pump coupled to the injector device via a valve of the first set of valves to boost the material from the mixing tank to drive a suction stroke directly when a valve of the second set of valves is open to pressure return.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A method comprising:

pumping fluid from a fluid source using at least one high pressure pump and directing the fluid to a wellbore;

diverting a portion of the fluid from the at least one high pressure pump to an injector device comprising a plunger pump comprising:

a housing comprising seals in the housing defining a driver side and a suction side of the housing with a middle portion therebetween establishing continuous fluid communication between the seals; and a plunger moveable within the housing in a reciprocating motion and comprising a plunger driver side having a first diameter and a plunger suction side having a second diameter less than the first diameter such that an area ratio of the plunger driver side to the plunger suction side is sufficient to overcome friction to move the plunger in the direction of the suction side in response to the fluid supplied into the driver side; and using the diverted portion of the fluid to power the injector device to inject material from a mixing tank to add the material to the wellbore in addition to a non-diverted portion of the fluid in the wellbore.

2. The method of claim 1, wherein diverting the portion of the fluid from the at least one high pressure pump to the injector device includes coupling the diverted portion of the fluid to two ports of a housing of the injector device, one of the two ports to power a suction stroke and the other port of the two ports to control injection.

3. The method of claim 1, wherein using the diverted portion of the fluid to power the injector device to inject material from the mixing tank includes operating valves coupled to the injector device to pull the material from the mixing tank using a suction stage of the injector device and to inject the material into the wellbore using an injection stage of the injector device.

4. The method of claim 3, wherein the method includes controlling activation of the valves in accordance with a timing sequence.

5. The method of claim 4, wherein the timing sequence is defined to operate the injection without accidental pressure releases during operation of the valves.

6. The method of claim 3, wherein using the suction stage of the injector device includes moving the plunger from the suction side of the housing to the driver side of the housing and using the injection stage of the injector device includes moving the plunger from the driver side of the housing to the suction side of the housing.

7. The method of claim 1, wherein the method includes boosting the material by a boost pump to drive a suction stroke of the plunger directly when a valve to the injector device is open to pressure return.

8. The method of claim 7, wherein the method includes metering fluid through a port in the middle portion of the injector device for use in a suction stroke and/or drive stroke of the injector device.

9. An apparatus comprising an injector device comprising a pump operable to inject material into a high pressure line, the pump being powered by a portion of a pressurized fluid diverted from the high pressure line, the pump comprising:

a housing comprising seals in the housing defining a driver side and a suction side of the housing with a middle portion therebetween establishing continuous fluid communication between the seals; and a plunger moveable within the housing in a reciprocating motion and comprising a plunger driver side having a first diameter and a plunger suction side having a second diameter less than the first diameter such that an area ratio of the plunger driver side to the plunger suction side is sufficient to overcome friction to move the plunger in the direction of the suction side and inject the material into the high pressure line in response to the fluid supplied into the driver side.

10. The apparatus of claim 9, wherein the apparatus includes: a first set of valves coupled to the suction side of the housing to regulate discharge of material from a mixing tank to exterior to the injector device;

a second set of valves coupled to the driver side of the housing to regulate supply and removal of fluid from the driver side; and a third set of valves coupled to the inlet of the housing to regulate supply and removal of fluid to control the motion of the plunger.

11. The apparatus of claim 10, wherein the apparatus includes a controller to control activation of valves of the first set of valves, the second set of valves, and the third set of valves in accordance with a timing sequence.

12. The apparatus of claim 9, wherein the apparatus includes an outer sleeve around the housing of the injector device.

13. The apparatus of claim 12, wherein the outer sleeve is arranged with the injector device to operatively pump fluid outside the injector device.

14. The apparatus of claim 12, wherein the outer sleeve is arranged to operatively heat the injector device.

15. The apparatus of claim 9, wherein the apparatus includes a boost pump coupled to the injector device to boost the material from a mixing tank to drive a suction stroke of the plunger directly when a valve to the injector device is open to pressure return.

16. A system comprising:

a fluid source arranged to operably contain a fluid;

at least one high pressure pump coupled to the fluid source and arranged to operatively pump the fluid from the fluid source to a wellbore;

a mixing tank arranged to operably contain material to add to the wellbore;

an injector device comprising a plunger pump comprising:

a housing comprising seals in the housing defining a driver side and a suction side with a middle portion therebetween establishing continuous fluid communication between the seals; and a plunger moveable within the housing in a reciprocating motion and comprising a plunger driver side having a first diameter and a plunger suction side having a second diameter less than the first diameter such that an area ratio of the plunger driver side to the plunger suction side is sufficient to overcome friction to move the plunger in the direction of the suction side to pump the material into the wellbore in response to the fluid supplied into the driver side;

a first set of valves coupled to the suction side of the housing to regulate discharge of a portion of the material from the mixing tank to the wellbore or a static mixer; and a second set of valves coupled to the driver side of the housing to regulate supply and removal of the fluid from the driver side.

17. The system of claim 16, wherein the system includes a shut down valve selectable to shut down operation of the injector device.

18. The system of claim 16, wherein the injector device comprises an inlet to the housing to provide the diverted fluid to control motion of the plunger and the system includes a third set of valves coupled to the inlet of the housing and operable to regulate supply and removal of the diverted fluid to control the motion of the plunger, and wherein the system further includes a controller operable to control activation of valves of the first set of valves, the second set of valves, and the third set of valves in accordance with a timing sequence.

19. The system of claim 16, wherein the first set of valves includes a first valve of the first set of valves coupled to the mixing tank and a second valve of the first set of valves coupled to the suction side of the housing.

20. The system of claim 19, wherein the system includes a safety system to prevent accidental flow back.

21. The system of claim 20, wherein the safety system includes a first check valve disposed between the first valve of the first set of valves and the suction side of the housing and a second check valve disposed between the second valve of the first set of valves and the wellbore.

22. The system of claim 16, wherein the system further includes a boost pump coupled to the injector device via a valve of the first set of valves to boost the material from the mixing tank to drive a suction stroke of the plunger directly when a valve of the second set of valves is open to pressure return.

23. The system of claim 16, wherein the injector device comprises an inlet to the housing to provide the diverted fluid to control motion of the plunger and the system includes a third set of valves coupled to the inlet of the housing and operable to regulate supply and removal of the diverted fluid to control the motion of the plunger, and wherein the system further includes a variable choke located between the at least one high pressure pump and the valve of the second set arranged to operatively receive the supply of the diverted fluid and also between the at least one high pressure pump and the valve of the third set arranged to operatively receive the diverted fluid from the at least one high pressure pump, wherein the variable choke is operable to control the motion of the plunger.

24. The system of claim 23, wherein the system includes:

a filter between the at least one high pressure pump and the variable choke.

25. The system of claim 23, wherein the system includes a controller operable to regulate the variable choke to regulate injection flow rate.

* * * * *